United States Patent [19]

Bart

[11] 4,365,819

[45] Dec. 28, 1982

[54] MERRY-GO-ROUND STROLLER

[76] Inventor: Philip D. Bart, 9864 NW. 13th Ct., Coral Springs, Fla. 33065

[21] Appl. No.: 189,643

[22] Filed: Sep. 22, 1980

[51] Int. Cl.[3] ..... B62B 7/02

[52] U.S. Cl. ..... 280/47.41; 46/205; 150/51; 272/31 R; 297/184; 297/244

[58] Field of Search ..... 280/47.34, 47.38, 47.41, 280/650, 87.02 W; 272/31 R; 46/204, 205; 297/184, 244, 254, 255; 150/50, 51

[56] References Cited

U.S. PATENT DOCUMENTS

| | | | |
|---|---|---|---|
| 1,058,881 | 4/1913 | Matushak | 46/204 |
| 1,186,005 | 6/1916 | Kessler | 46/205 |
| 1,243,295 | 10/1917 | Hugler | 46/205 |
| 1,427,296 | 8/1922 | Jakubiec | 272/31 R |
| 1,566,411 | 12/1925 | Lopez | 272/31 R |
| 1,574,402 | 2/1926 | Matushak | 46/204 |
| 3,102,361 | 9/1963 | Peninger | 46/205 |
| 3,187,461 | 6/1965 | Vicini | 46/205 |
| 3,309,101 | 3/1967 | Romay | 280/47.38 |

FOREIGN PATENT DOCUMENTS

| | | |
|---|---|---|
| 204120 | 9/1923 | United Kingdom . |
| 1513505 | 6/1978 | United Kingdom . |

*Primary Examiner*—Joseph F. Peters, Jr.
*Assistant Examiner*—Michael Mar
*Attorney, Agent, or Firm*—Daniel M. Rosen

[57] ABSTRACT

A stroller for transporting a doll when pushed or pulled by a child has a pair of wheels secured to and rotatable with a horizontal axle, a right angle gear transmission from the axle to a vertical central shaft which is rotated when the stroller is propelled forward or backward. The top end of the vertical shaft is secured to and passes through the center of a frame formed as a seat for receiving and holding at least one doll. Rotation of the wheels when the stroller is pulled or pushed causes corresponding rotation of the vertical shaft and the canopy and the seat and doll therein.

8 Claims, 6 Drawing Figures

MERRY-GO-ROUND STROLLER

BACKGROUND OF THE INVENTION

Baby carriages or strollers for infants and miniaturized versions for dolls are well known in the prior art. These vehicles usually have one or two pairs of wheels on horizontal axles, a seat support area for the infant or doll mounted on the chassis, and a handle for manually pulling or pushing the apparatus.

Merry-go-round apparatus are also known in the prior art as rotating platforms secured to a stationary base with a canopy at the top and a plurality of vertically oscillating mechanized animals on which participants sit while the overall platform rotates to the sound of music.

Merry-go-rounds traditionally are loud and exciting with dramatic movement as participants ride their particular mechanical animals. Strollers are quiet and sedate by comparison, as they merely roll along when pushed or pulled. The present invention seeks to provide a toy vehicle which appears and functions like a stroller for transporting a doll, but at the same time seeks to operate with the dramatic flair and rotation of a carousel. The new structure seeks to utilize from the stroller's movement power that is normally supplied from the stationary base of a traditional carousel, as a combination of the various features of two totally different apparatus, one of which is a toy and the other a mechanized structure the size of a small building. A summary of the invention and a detailed description of the preferred embodiment of the same follow below.

SUMMARY OF THE INVENTION

The new invention is a merry-go-round stroller apparatus for receiving and transporting at least one doll when the stroller is manually pushed or pulled on a floor surface and for rotating that doll and the canopy above the doll while the vehicle is moved forward or backward. The new device includes a chassis through which extends an axle with first and second wheels rotatably mounted at each end thereof. This is a drive axle with a drive pinion secured intermediate its ends, the teeth of the pinion engaged to rotate a face gear on a vertical central shaft extending upward through the chassis. At the top end of the shaft is rotatably mounted the canopy or umbrella, and intermediate the top and bottom ends is a yoke or collar for attachment to a seat frame which receives and supports a doll. Preferably the attachment between the central shaft and seat frame is a cylindrical member with a central bore through which the central shaft extends and a transversely extending flange part for attachment to the seat frame. A further embodiment of the invention includes a music box which produces musical sound when its actuator is rotatably driven by the face gear or any other rotary drive from the main drive axle, and electric motor, or alternative means. A simple housing surrounds and encases the chassis and transmission components, with the music box also housed therein. For supporting the doll the seat and frame are formed preferably of rod or band material formed into a pair of rectangles, one being generally vertical and the other horizontal, the two being joined at the mid points of their mutual ends. A sheet material or fabric or vinyl is formed to drape over the vertical top part, hang down on both sides thereof and then bend transversely forward for the front seat and rearward for the back seat. Each seat is formed so that a doll can be positioned downward with its legs straddling a central strap and hanging out of the seat, similarly as an infant would sit in a real stroller. The seat frame as described has two back-to-back seats and therefore can accommodate one or more dolls in each side thereof. A detailed structural description of the preferred embodiment along with drawings of same will now be included in the paragraphs below.

DESCRIPTION OF THE FIGURES AND PREFERRED EMBODIMENT

Figure 1:
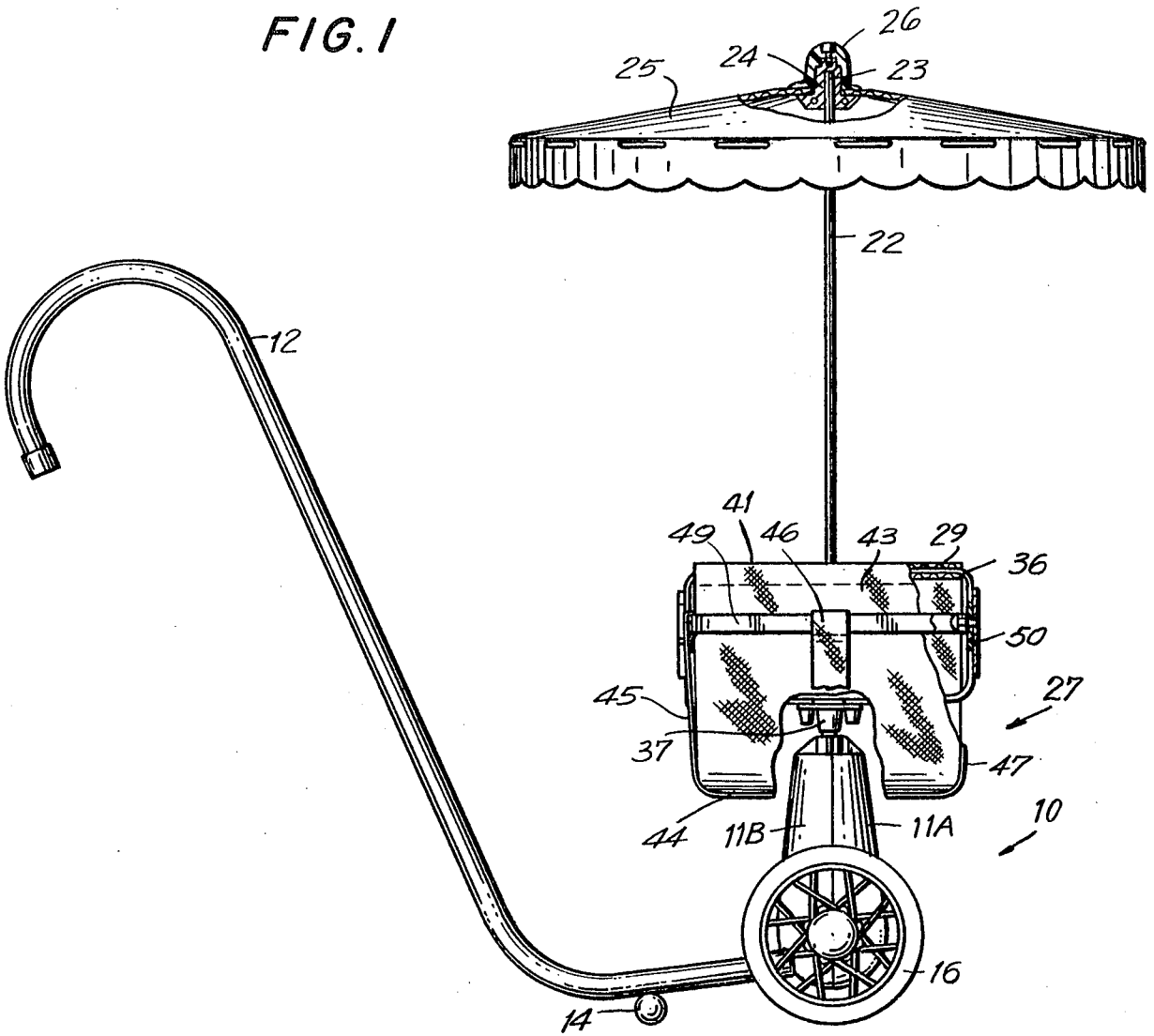
FIG. 1 is a side elevation view of the new merry-go-round stroller.
Figure 3:
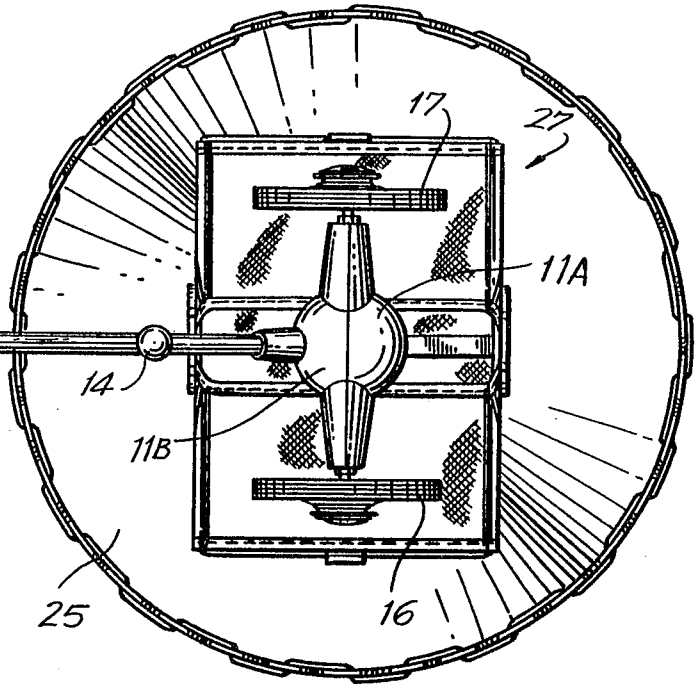
FIG. 3 is a bottom plan view thereof.
Figure 2:
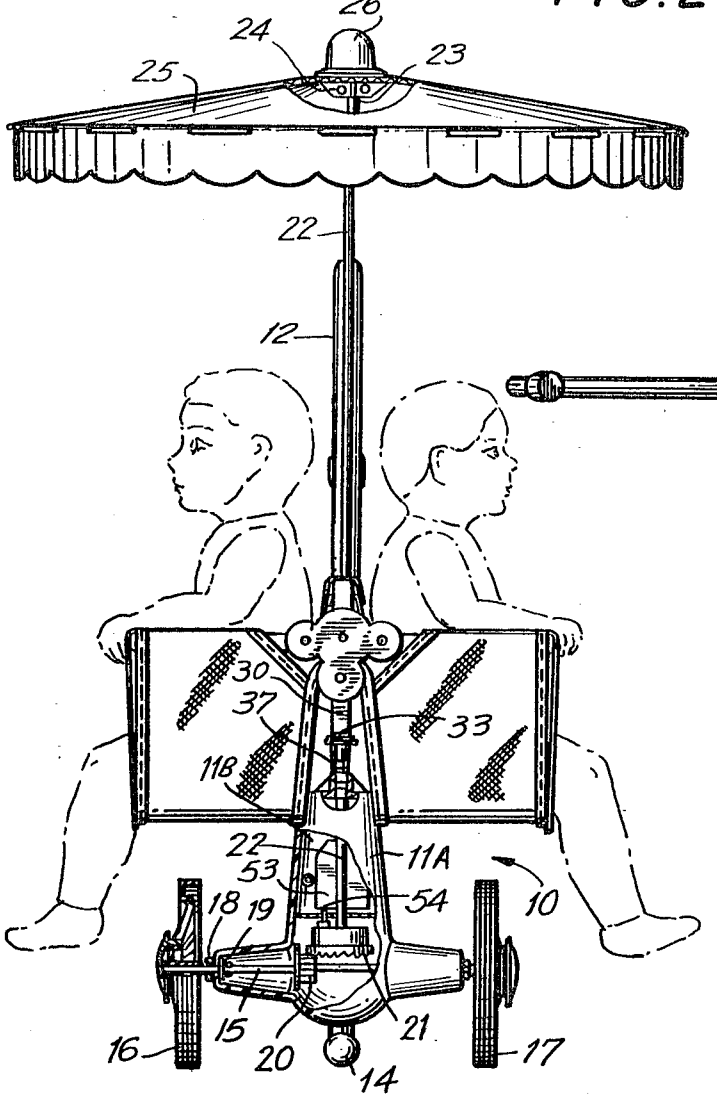
FIG. 2 is a front elevation view in partial section thereof.

The merry-go-round stroller shown as vehicle 10 in FIGS. 1 and 2 has a chassis or housing comprising a front part 11*a* and a rear part 11*b*, together forming a tubular member having a central axis and which when oriented upright extends generally upward. A handle 12 extends from the rear part, the handle being a tubular member which is secured in the rear housing by a screw fastener or other means. Beneath the handle and spaced a short distance from the housing is a glide member 14 which serves as the third contact with the ground along with the two wheels; when the user of this apparatus stops the pulling or pushing effort and allows the handle to fall downward toward the ground, the glide will contact the ground so that the stroller remains in a generally upright position.

Extending horizontally through the housing is a drive axle 15 with wheels 16 and 17 secured at each end for rotation with axle 15. Typical bearings 18 are provided at each end of the axle and mounted in the housing for proper rolling contact, and flat washers 19 are provided to establish the proper axial position of the drive axle 15 in the housing 11.

Intermediate the ends of drive axle 15 gear transmission coupling, is drive pinion 20 which is fixed on the shaft for rotation therewith and has teeth which engage with face gear 21 which rotates about a vertical axis perpendicular to the drive axle 15. In the embodiment shown the diameter of the face gear is approximately twice that of the drive pinion so that two rotations of the drive axle and wheels would be required for one rotation of the vertical central shaft 22.

At the top end 23 of center shaft 22 is a connection device 24 for securing to shaft 22 the canopy 25 which is essentially an umbrella comprising a fabric canopy on a frame with a carousel cap 26 closing and securing the upper assembly area and adding a decorative effect. As indicated earlier shaft 22 rotates proportionally slower than the principal wheels 16 and 17, and the carousel or umbrella rotates directly with the central shaft.

Figure 5:
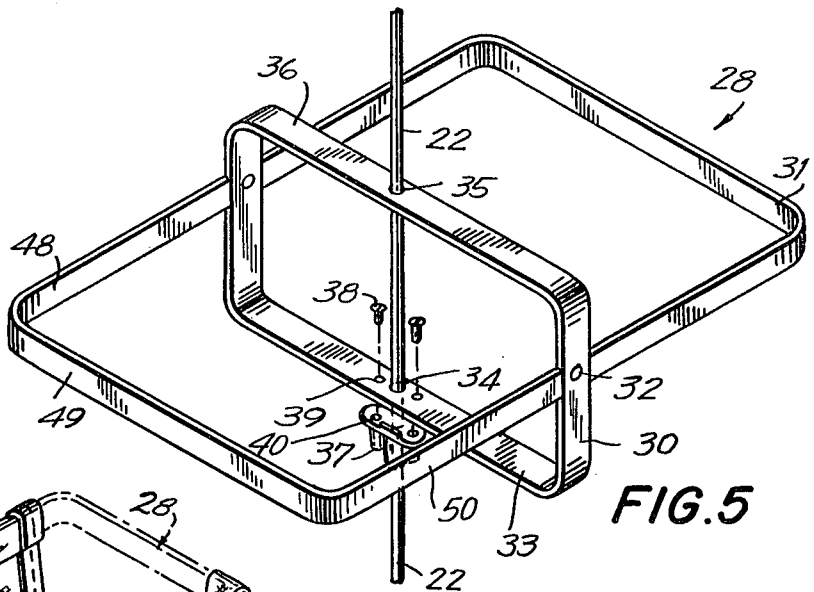
FIG. 5 is a similar perspective view of the frame alone from FIG. 4.
Figure 6:
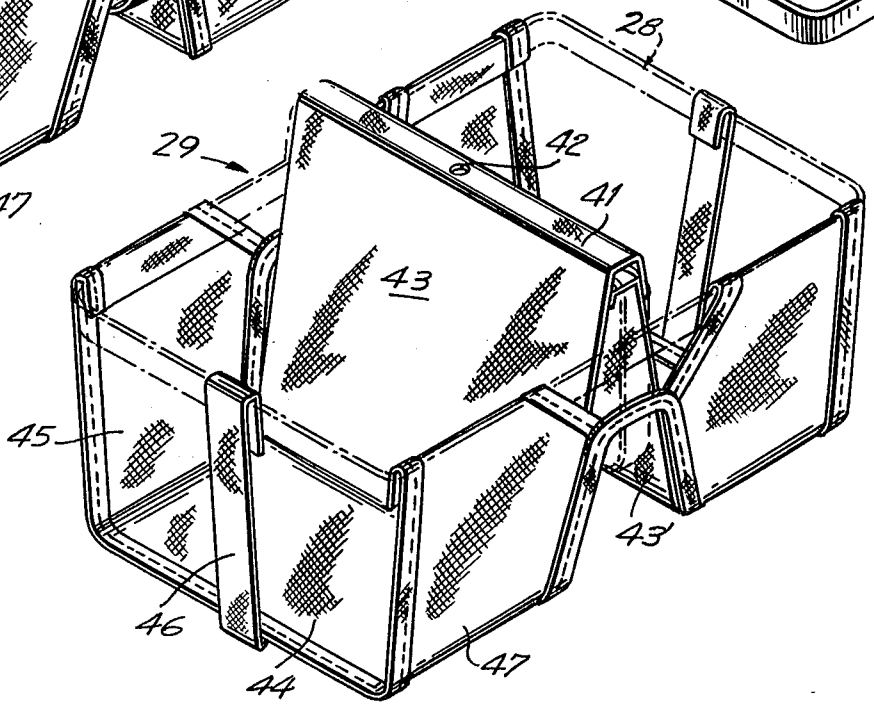
FIG. 6 is a similar front perspective view of the sheet material seat support of FIG. 4.
Figure 4:
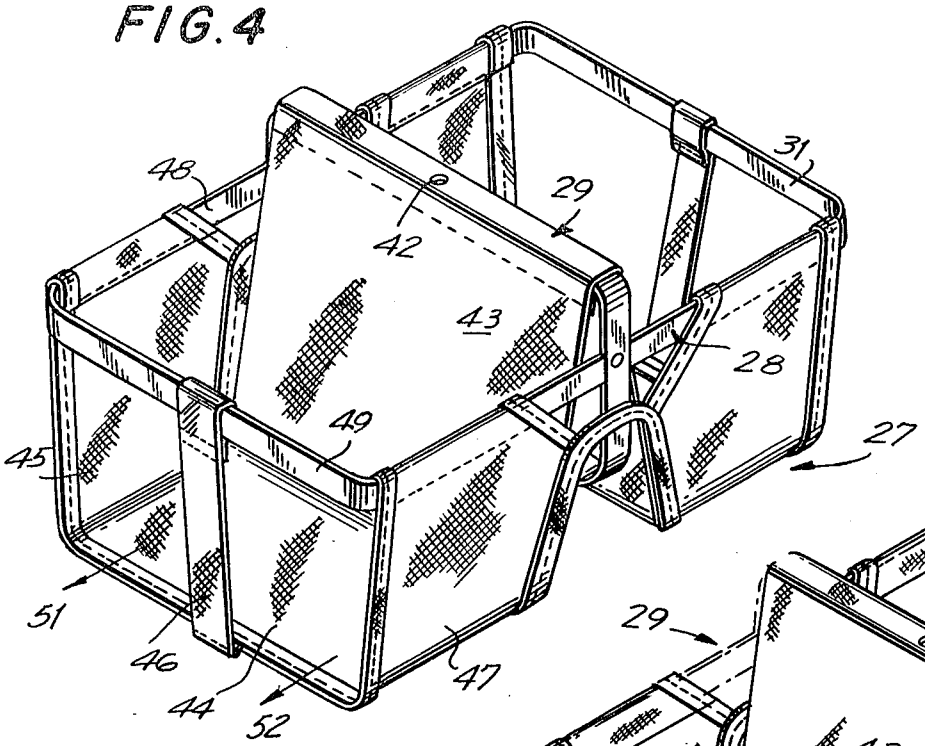
FIG. 4 is a side perspective view of the seat frame and seat fabric as a subassembly.

Intermediate the ends of shaft 22 is the seat portion for receiving and holding a doll, obviously simulating an infant in a baby carriage/stroller. The seat assembly 27 consists of a frame part 28 and a sheet or fabric 29 defining the support area. FIGS. 4, 5 and 6 illustrate the seat assembly more clearly and correspond directly to the seat assembly generally shown in FIGS. 1 and 2.

The frame 28 consists of a vertical band 30 joined to a horizontal band 31 at junction 32 by any practical fastening means. As shown in FIG. 5 the bottom portion 33 of frame 28 has a central aperture 34 aligned with a corresponding aperture 35 in the top part 36 of this frame. A yoke 37 is secured on shaft 22 to rotate with it, and this yoke is then secured to bottom part 33 by fastening means 38 extending through holes 39 and 40 in the bottom part 33 and yoke 37 respectively. By this arrangement the frame is caused to rotate whenever shaft 22 rotates along with the canopy.

FIG. 6 shows the seat support or saddle bag type arrangement 29 made of fabric or other sheet material. Central part 41 of the seat support is intended to sit upon upper frame member 36 with hole 42 provided to allow shaft 22 to extend upward as shown earlier. Side walls 43 of the seat support extend downward from the top part 41, and then extend horizontally as seat bottom 44. For each seat bottom there are upward extending straps 45, 46 and 47 which are intended to engage and be secured to parts 48, 49 and 50 respectively of the horizontal band 31 in FIGS. 5 and 4. As indicated in FIG. 4 a doll simulating an infant could be seated with its legs straddling the strap 46 and extending outward in the areas marked by arrows 51 and 52, or alternatively two or more dolls or doll animals could be placed in the seat area defined by portion 44.

The above-described structural components and assembly may be summarized as follows. The stroller comprises a chassis, a drive axle and 1st and 2nd wheels rotatably mounted on the chassis with at least one of the wheels coupled to and rotatable with the drive axle. An upwardly extending central shaft has a lower end driven through a pair of gears by the drive axle, an upper end coupled to and rotatable with the canopy, and an intermediate part coupled to and rotatable with the seat for supporting the dolls. The seat comprises walls and a base defining two receptacles or recesses, each opening upward for receiving a doll, the walls defining additional openings for feet of the doll to extend laterally therethrough. The seat is formed by a frame comprising a generally rectangular first band oriented in a generally vertical plane which separates the receptacles, the 1st band having top and bottom parts and opposite end parts, and a generally rectangular 2nd band oriented in a generally horizontal plane with opposite side parts and opposite end parts, the end parts of said 1st and 2nd bands being secured together. A fabric or other flexible sheet material extends downward from the second band and from the top part of the 1st band as walls and extends from the walls laterally providing the base of the seat.

Another feature of this apparatus is a music box 53 illustrated in FIG. 2 where it is mounted to housing **11*b* and has an actuator 54 positioned to be engaged and rotated by face gear 21. Accordingly when this vehicle is pulled or pushed and wheels 16 and 17 are caused to rotate, the face gear 21 as rotated will drive the music box 53 simultaneously with driving the central shaft 22 and its connected seat assembly 27 and canopy or carousel 25**.

The invention herein is intended to create a carousel of the rotating type which is not restricted to a stationary base and is driven to rotate by means essentially independent of the carousel and means which is highly simple, effective and inexpensive. The resulting apparatus has achieved all these objectives by having the fewest possible parts, and has rendered the various components to be interactive while also be independent, and has introduced a concept heretofore not seen in the prior art wherein a seat part of a stroller is rotated along with the overhead carousel while the vehicle is pulled or pushed by a user.

The above described embodiment is merely a preferred version of the invention which may take numerous forms, all considered within the scope and spirit of the appended claims.

What is claimed is:

1. A merry-go-round stroller for receiving, transporting and rotating at least one doll when the stroller is moved on a floor surface, the stroller comprising: a chassis, a drive axle rotatably mounted on said chassis, first and second wheels rotatably mounted to said chassis to roll on said floor surface, at least the first of said wheels coupled to and rotatable with said drive axle, a shaft rotatably mounted on said chassis is generally upwardly extending orientation, said shaft having lower and upper axially-spaced parts and an intermediate part therebetween, first means coupling said axle and said lower part of said shaft in rotational drive relationship, a canopy secured to said upper part of said shaft and rotatable therewith, and a seat defining two adjacent receptacles each of which has a base for supporting said dolls and an upward facing opening, said seat comprising a frame formed by a generally rectangular first band orientated in a generally vertical plane which separates said receptacles, said first band having top and bottom parts and opposite end parts, and a generally rectangular second band oriented in a generally horizontal plane with opposite side parts and opposite end parts, said end parts of said first and second bands secured together, said second band at least partially defining the shape of said receptacle openings, said top and bottom parts of said first band each having an aperture, said apertures being axially aligned with said intermediate part of said shaft extending therethrough, and means for fixedly securing said first band to said intermediate part of said shaft for rotation therewith, whereby rotation of said first wheel, when said stroller is moved on said floor surface, rotates said axle, thereby rotating said shaft, seat and canopy.

2. A stroller according to claim 1 wherein said seat further comprises thin, flexible sheet material extending downward from said second band and from the top of said first band thereby defining walls of said receptacles and extending laterally from said walls thereby defining said base of said seat.

3. A merry-go-round stroller for receiving, transporting and rotating at least one human-like doll when the stroller is moved on a floor surface, the stroller comprising: a chassis, a drive axle rotatably mounted on said chassis, first and second wheels rotatably mounted to said chassis to roll on said floor surface, at least said first of said wheels coupled to and rotatable with said drive axle, a shaft rotatably mounted on said chassis in a generally upward extending orientation, said shaft having lower and upper axially-spaced parts and an intermediate part therebetween, first means coupling said axle and said lower part of the shaft in rotational drive relationship, a canopy fixed to and rotatable with said upper part of said shaft, and a seat for receiving and supporting said doll, said seat secured to said intermediate part of said shaft and rotatable therewith, said seat being a container having a laterally extending base and upwardly extending walls which together define at least two adjacent recesses, each recess opening upwardly for receiving a doll, said walls defining therein for each recess an additional opening for feet of said doll to extend laterally therethrough, said container comprising a first element formed as a closed loop defining a laterally extending plane and a second element extending transversely across and engaging and dividing said closed loop into said upward facing openings of said two recesses, said walls of said container extending downward from portions of said first and second elements and said base extending transversely between said walls, whereby rotation of said first wheel when said stroller is moved on said floor surface rotates said axle, thereby rotating said shaft, seat and canopy.

4. Apparatus according to claim 3 wherein said walls and base of said comprising sheet material.

5. A device according to claims 1 or 3 further comprising a music means which produces a musical sound when an actuator thereof is rotated, said music means being secured to said chassis with said actuator engaged to and rotated by said first means so that movement of said stroller and rotation of its drive wheel causing rotation of said first means causes the music means to produce musical sounds.

6. A device according to claims 1 or 3 wherein said drive axle has first and second axially-spaced ends, and said first and second wheels are secured to said ends respectively.

7. A device according to claims 1 or 3 further comprising a yoke means having a sleeve part with a central bore through which extends and is fixed thereto said central shaft's intermediate part, and a flange part secured to said seat frame.

8. A merry-go-round stroller for receiving, transporting and rotating at least one doll when the stroller is moved on a floor surface, the stroller comprising: a chassis, a drive axle rotatably mounted on said chassis, first and second wheels rotatably mounted to said chassis to roll on said floor surface, at least the first of said wheels coupled to and rotatable with said drive axle, a shaft rotatably mounted on said chassis in a generally upwardly extending orientation, said shaft having lower and upper axially-spaced parts and an intermediate part therebetween, first means coupling said axle and said lower part of said shaft in a rotational drive relationship, a canopy secured to said upper part of said shaft and rotatable therewith, and a seat defining two adjacent receptacles each of which has a base for supporting said dolls and an upward facing opening, said seat comprising a frame formed by a generally rectangular first band oriented in a generally vertical plane which separates said receptacles, said first band having top and bottom parts and opposite end parts, and a generally rectangular second band oriented in a generally horizontal plane with opposite side parts and opposite end parts, said end parts of said first and second bands secured together, said second band at least partially defining the shape of said receptacle openings, said intermediate part of said shaft being adjacent said top and bottom parts of said first band, and means for fixedly securing said first band to said intermediate part of said shaft for rotation therewith, whereby rotation of said first wheel when said stroller is moved on said floor surface rotates said axle, thereby rotating said shaft, seat and canopy.

* * * * *